US006663030B2

(12) United States Patent
Washburn et al.

(10) Patent No.: US 6,663,030 B2
(45) Date of Patent: Dec. 16, 2003

(54) REPLACEABLE GRATE DEVICE FOR MAXIMIZING THE THROUGHPUT OF SOLID MATERIAL IN ORE MILLS

(76) Inventors: Jeffrey H. Washburn, 3479 Vivian Ave., Shoreview, MN (US) 55432; Gary G. Edwards, 248, 119th Ave. NE., Blaine, MN (US) 55434

( * ) Notice: Subject to any disclaimer, the term of this patent is extended or adjusted under 35 U.S.C. 154(b) by 58 days.

(21) Appl. No.: 10/105,019

(22) Filed: Mar. 21, 2002

(65) Prior Publication Data

US 2003/0178516 A1 Sep. 25, 2003

(51) Int. Cl.[7] ..... B07C 7/00; B02C 7/00
(52) U.S. Cl. ..... 241/70; 241/299
(58) Field of Search ..... 241/69, 70, 71, 241/72, 88.4, 181, 182, 183, 299

(56) References Cited

U.S. PATENT DOCUMENTS 1,642,122 A * 9/1927 McMahon ..... 241/70
1,690,493 A * 11/1928 Marcy ..... 241/70
3,219,284 A * 11/1965 Fahlstrom et al. ..... 241/70
3,894,696 A * 7/1975 Jonsson ..... 241/70
5,829,693 A * 11/1998 Schenk et al. ..... 241/72

* cited by examiner

*Primary Examiner*—Allen Ostrager
*Assistant Examiner*—Jimmy T Nguyen
(74) *Attorney, Agent, or Firm*—Merchant & Gould P.C.

(57) ABSTRACT

A grate segment fastening system for an ore grinding machine, comprising a grate, including a top surface and a bottom surface opposite the top surface, wherein the top surface and the bottom surface are separated by a grate thickness, the grate being defined in use by an axis end, and a circumferential end opposite the axis side; wherein the grate is further defined by a second lateral surface, and a first lateral surface opposite the second lateral surface, the first lateral surface further comprising a raised mounting portion wherein at least one mounting bore extends into and through the body of the raised mounting portion, a plurality of throughput apertures extending through the grate from the top surface to the bottom surface and, a grate holder, including a top surface and a pulp lifter contact surface, opposite the top surface, the grate holder being defined by an axial end, and a circumferential end opposite the axial end, an anchor bore of predetermined transverse size extending from the top surface to the pulp lifter contact surface, a mounting bore of predetermined transverse size extending at least partially into the mounting surface, and; a threaded member insertable through a mounting bore of the grate into an aligned mounting bore on the grate holder.

23 Claims, 11 Drawing Sheets

REPLACEABLE GRATE DEVICE FOR MAXIMIZING THE THROUGHPUT OF SOLID MATERIAL IN ORE MILLS

FIELD OF THE INVENTION

This invention broadly relates to grate devices for ore grinding or ore comminuting machines in commercial mining operations. More specifically, this invention is directed to an improved system for replacing and fastening grates to the rotatable interior of an ore grinding or ore comminuting machine.

BACKGROUND OF THE INVENTION

Commercial mining operations require the use of ore comminuters or grinders, which reduce the size of large ore fragments for further refining. Several types of ore comminuters or grinders may be used, one of which takes the form of a large cylindrical rotatable shell that is rotated on a substantially horizontal axis and is driven by a very powerful motor through conventional reduction gearing. With this type of grinder, ore is introduced into one end of the drum through an inlet, and after reduction or comminution, the reduced ore is discharged through an outlet in the opposite end.

Within the drum, the charge of ore fragments rests at the bottom of the rotating drum. As the drum rotates, part of the ore charge is carried upwardly along the contoured inner surface of the drum until the carried fragments drop from the drum surface due to gravity, tumbling back onto the ore charge and breaking the fragments. This continuous process reduces the size of the fragments until they become small enough to pass through apertures in grate segments. These fragments are then discharged from the mill.

Individual grate segments are typically mounted on pulp lifters within the interior cylindrical surface of the rotatable drum. The individual grate segments are composed of a series of apertures with a predetermined size. Apertures in grate segments generally will range from 0.25" to 4"(0.6–10.2 cm) depending on the specific application, with 1" to 3"(2.5–7.6 cm) apertures being typical for most industry applications. An ore fragment must pass through at least one of the apertures before it is able to exit the mill. The grate segments are cast from alloys that are optimized to increase the wear rate while avoiding breakage caused by impacts from the ore charge and grinding media.

To maximize economic efficiency, ore comminuting mills of this type generally operate continuously, 24 hours a day. The ores being comminuted are highly abrasive. Therefore the continuous process wears the grate segments down over a period of time, depending on the type of ore and application. When grate apertures become worn, ore fragments that exit the mill may become larger than desired. When this happens, the grate segments must be replaced. It is desirable to replace the series of individual grate segments as quickly as possible because down time of the ore comminuting mill adversely affects the economic efficiency of the process.

Even when grate segments are not worn, it may be desirable to replace grates segments containing apertures of one size with grate segments containing apertures of a different size. This is especially important when the same ore grinder is used for variable ore types.

The process of replacing the series of individual grate segments presents certain problems that are not immediately evident. For example, the mere size of the equipment presents practical difficulties. A typical mill can measure 15 feet (4.6 m) long and over 28 feet (8.5 m) in diameter. Individual grate segments are commonly 2.5 to 4 inches (6.4–10.2 cm) thick, may be up to 4 feet (1.2 m) high and 6 feet (1.8) wide, and typically weigh up to several thousand pounds.

Individual grate segments that line the drum of the mill are conventionally fastened to pulp lifters on the cylindrical shell by transverse mounting bores that extend from the grinding surface to the mounting surface of the cylindrical drum. Each pulp lifter may include two such mounting bores. The cylindrical shell has the same number of mounting bores that are similarly spaced, permitting the mounting bores of the segments to be positioned in alignment. Once aligned, bolts are passed from the inside of the shell through the grate segments and the aligned mounting bores in the shell.

This type of segment fastening system works quite well in installing the individual grate segments. However, the bolt heads may be exposed at least partially to the comminution process, and by the time the grate segments require replacement, the bolt heads may be severely deformed. The continuous bombardment of fragments usually causes peening of the casting immediately around the bolt head, which may occlude the head and reduce its accessibility for removal.

Furthermore, there is at least some minimum space necessary between the sides and ends of adjacent grate segments to permit installation. During the ore comminution process, ore fines tend to fill up these spaces and are compacted in place. The grate segments may also be peened onto each other. This results in significant difficulty in removing the compacted grate segments when replacement is necessary. Even if the external nuts or the mounting bolts are removed relatively easily, this does not release the individual grate segments because of such compacting. Further, the bolts themselves have significant shear forces placed on them during the ore comminution process, often causing deformation to the point that they become skewed and tightly lodged within the interior of the rotating drum. The force necessary to remove a particular grate segment often requires the use of a crane and heavy hammering equipment.

Another approach that may be used instead of or in addition to forcibly hammering the bolts or grate segments is torch cutting the worn material from within the rotating drum. If the bolt head can be reached effectively by torch cutting, the bolt may be removed, thereby facilitating segment removal.

As will be appreciated, the conventional fastening of liner segments results in difficult grate segment removal when replacement is necessary, and this in turn causes significant mill down time.

The present invention is directed to a grate segment fastening system that can make grate segment installation and removal easier and less time consuming.

SUMMARY OF THE INVENTION

The present grate segment fastening system comprises a grate segment, and a grate holder. The grate segment is designed to work in conjunction with corresponding sides of the grate holder segments. For example, the grate segment generally may be configured with tabs on one end and mounting bores on the other end. The grate holder segments can be anchored onto existing pulp lifter sections on the interior of an ore grinder. The grate holder segments are typically anchored with threaded bolts or similar fastening means. In any case, the holder segments contain anchor bores that are configured to align with corresponding bores on the existing holder segments.

For assembly, in one example the grate segment is placed between adjacent holder segments so that the tabs interlock with recessed portions on one side of the grate holder. Once the tabs are securely in place, the grate is rotated until the mounting bores on the grate come into alignment with mounting bores on the other holder segment. Once the grate is in place, elongated members, such as bolts or pins, may be inserted through the mounting bores on the grate and into the mounting bores on the other grate holder segment. After the bolts or pins are inserted, protective plug members may be inserted over the bolts or pins to protect them from wear caused by the internal operation of the mill.

Preferably, the grate and grate holders are cast from a ferrous alloy such as pearlitic steel or martensetic white iron. In any case a suitable material can be chosen to maximize the wear-resistant characteristic of the grate holder while avoiding breakage due to brittleness.

In a typical milling scenario, the present invention would be used with existing mills to enable milling personnel to replace grate segments with less effort than present systems require. For example, preferred embodiments of the present invention only require the removal of two elongated members from the mounting bores on the grate. Then, the mounting end of the grate segment will rotate upward and away from the interior wall of the mill. At this point, the tabs on the grate easily can be slid outward from the recesses on the grate holder, thereby releasing the grate from the mill structure.

The grate holder segments then can be inspected visually to determine whether they need replacing. If they do not require replacement, a new grate segment easily can be installed by sliding its tabs into the recesses in the grate holder and aligning the mounting bores on the grate and grate holder. Elongated members are then inserted into the mounting bores, thereby locking the new grate in place. The holder can typically last through the effective wear life of at least two grate segments.

DETAILED DESCRIPTION OF THE PREFERRED EMBODIMENT

Figure 1:
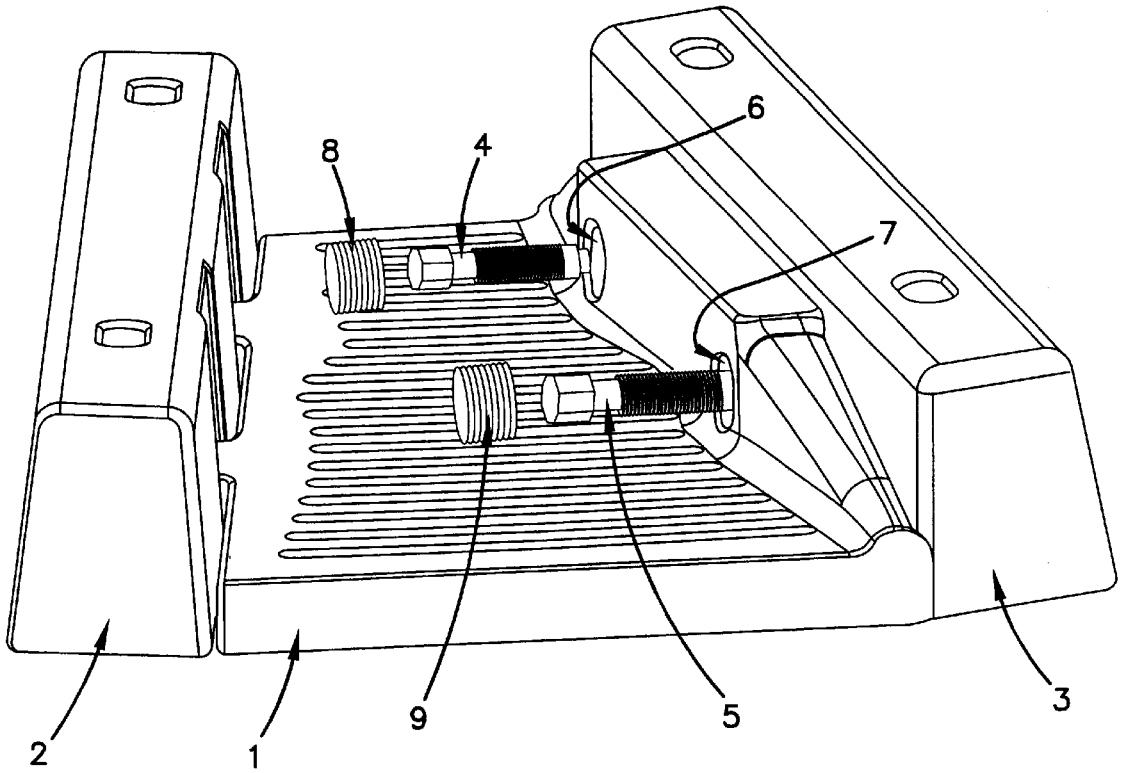
FIG. 1 is a schematic perspective view of the grate segment fastening system according to the present invention.
Figure 11:
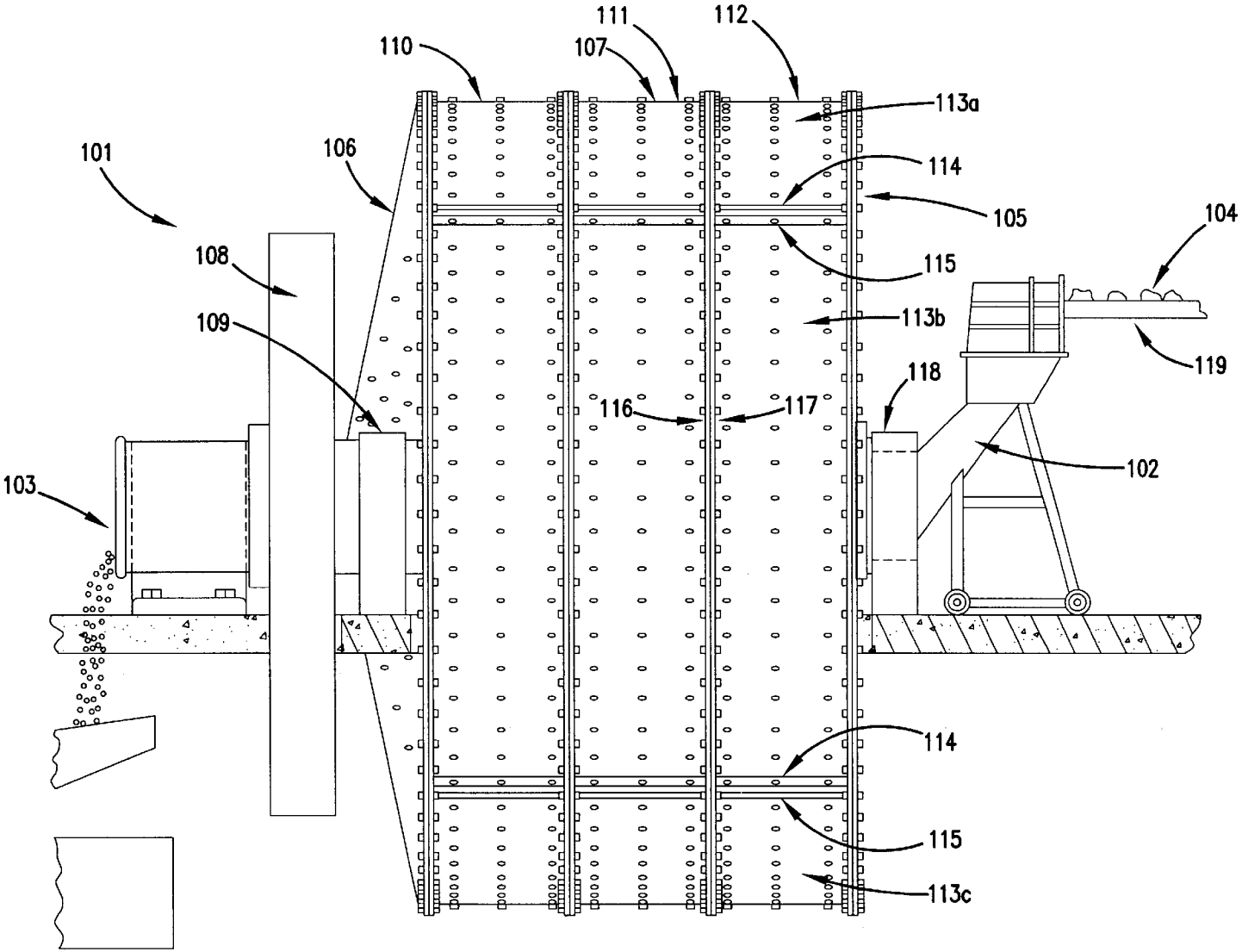
FIG. 11 is a side elevational view of an ore grinding mill for reducing the size of ore fragments.

With initial reference to FIG. 1, a grate segment fastening system is shown with its component parts. The grate 1 is disposed between two similarly configured grate holders 2 and 3. Threaded members 4 and 5 are shown near mounting bores 6 and 7 that are used to fasten the grate 1 to grate holder 3. Protective plug members 8 and 9 are shown near the threaded members 4 and 5. In an alternative embodiment, the protective plug members 8 and 9 will cover corresponding threaded members 4 and 5. For reference, FIG. 11 generally shows an ore grinding mill 101 employing the inventive grate assembly. Mill 101 includes a hollow cylindrical drum or shell 107 having an inlet end 105 and an outlet end 106.

The cylindrical drum 107 is arranged for rotation about a substantially horizontal axis in suitable bearings 109, 118 by a drive of conventional construction in a housing 108. A inlet 102 communicating with the axial inlet receives ore fragments 104 from a conveyor 119. The comminuted material leaves the mill 107 through the outlet 103.

Cylindrical drum 107 is made up of a plurality of cylindrical sections 110–112, each of which in turn is assembled from a set of cylindrical quadrants by bolts extending through axial flanges. For example, section 112 consists of quadrants 113*a*, 113*b*, and 113*c* (one quadrant is not shown) which are secured together circumferentially by a plurality of bolts passing through radially extending, axially aligned flanges 114, 115. The cylindrical sections 111, 112 are secured together axially by a plurality of bolts passing through circumferential flanges 116, 117 extending radially from the periphery of each side. Cylindrical sections 111, 112 are secured in an identical manner, as are the inlet end 105 and the outlet end 106 to the cylindrical sections 112, 110, respectively.

Figure 12:
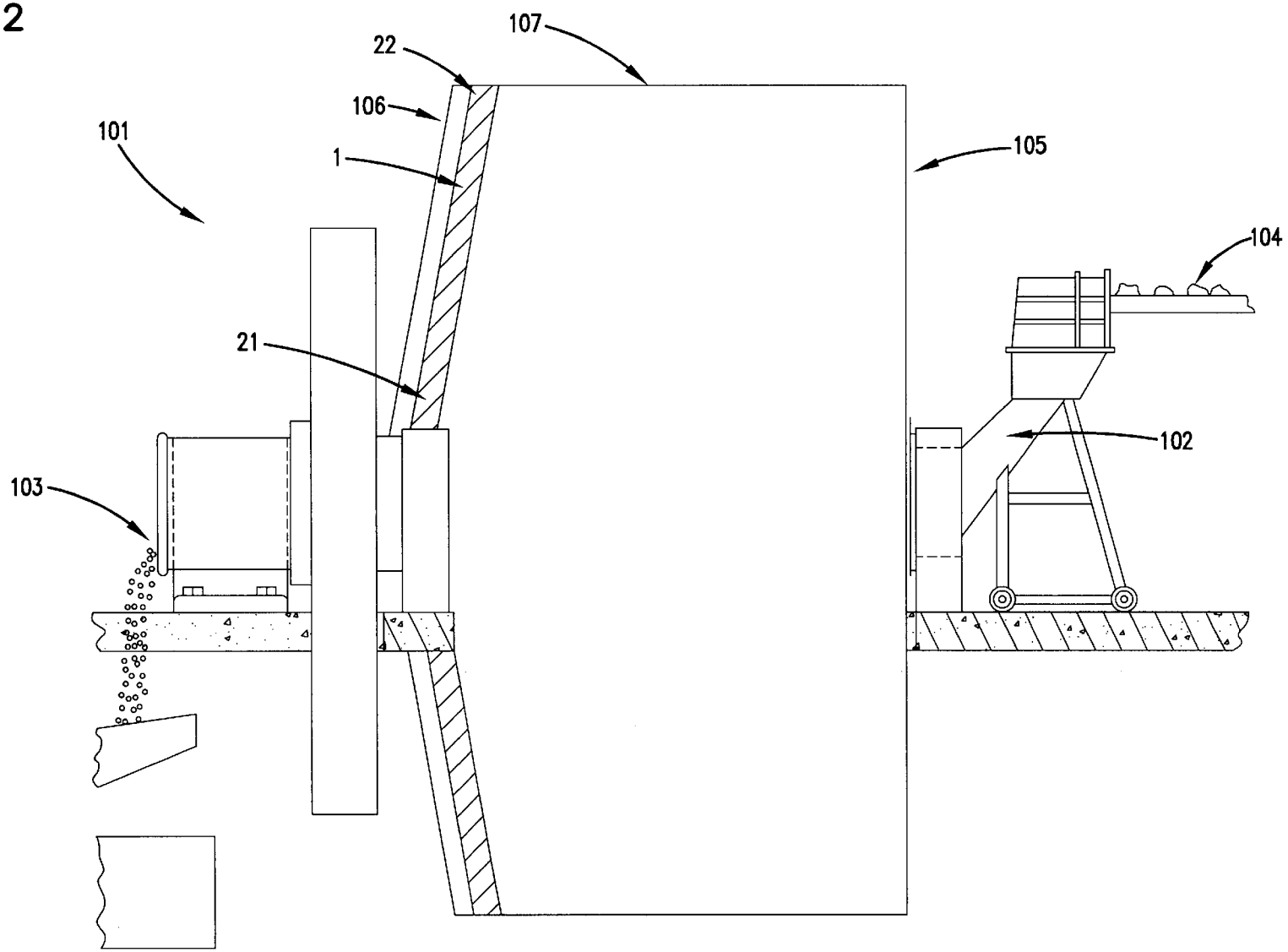
FIG. 12 is cross-sectional view of a ore grinding mill.

FIG. 12 generally shows a cross-sectional view of an ore grinding mill 101 with grates 1 and 1' in their operating environment. The inlet 102 and outlet 103 of the ore grinding mill 101 are also shown for reference.

Figure 2:
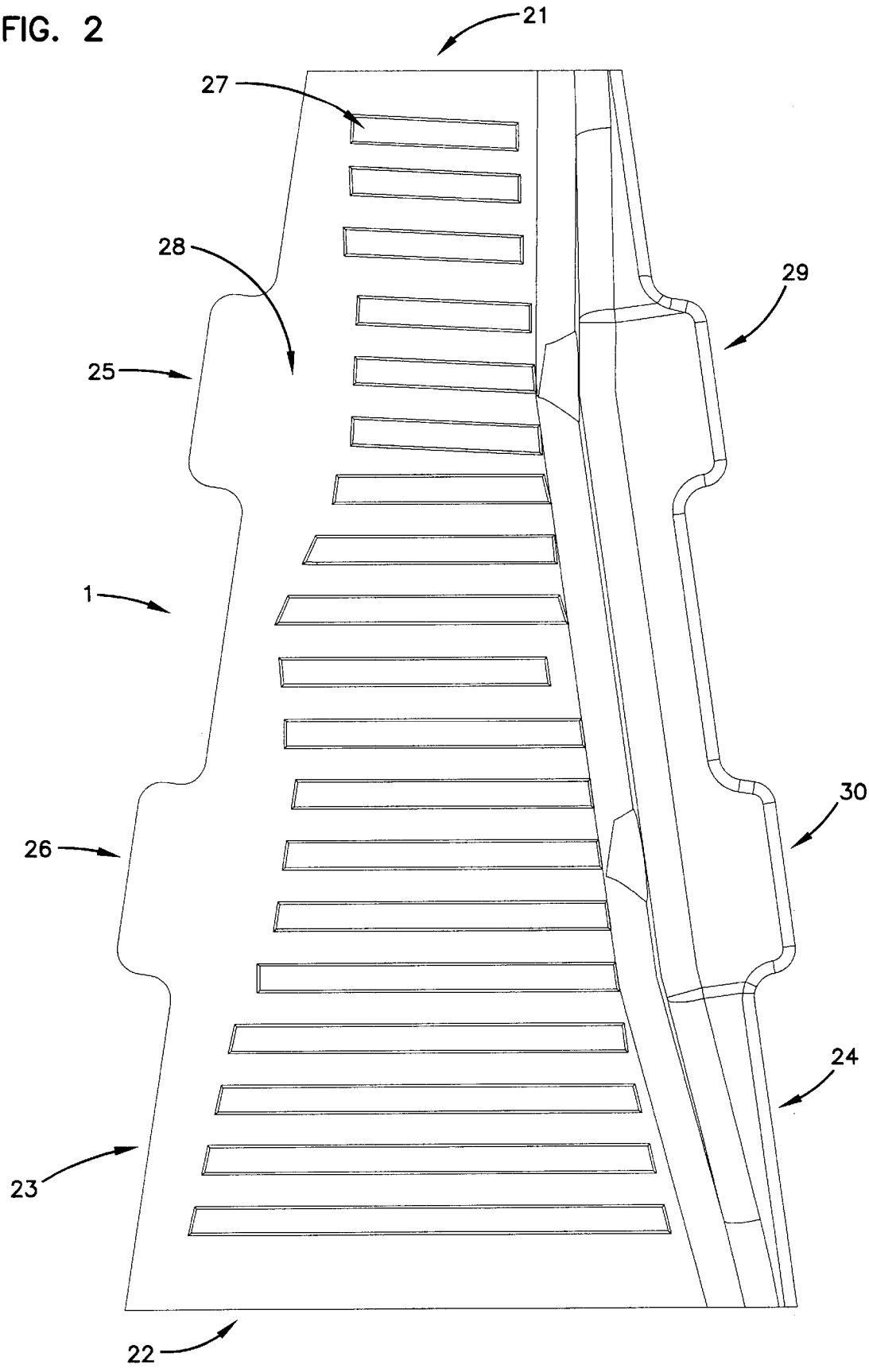
FIG. 2 is a top view of the grate segment.

FIG. 2 shows grate 1 which illustrates the top surface 28. The grate 1 is typically cast from a ferrous alloy such as pearlitic steel or martensetic white iron. In any case a suitable material should be chosen to maximize the wear-resistant characteristic of the grate 1 while avoiding breakage due to brittleness.

With continued reference to FIG. 2, the grate 1 defines an axis end 21 and a circumferential end 22, which is located opposite the axis end 21. The grate 1 is further defined by a second lateral surface 23 and a first lateral surface 24, which is located opposite the second lateral surface 23. Tabs 25 and 26 extend outwardly from the second lateral surface 23 as shown. The grate 1 may have one tab 25, or a plurality of tabs, as shown in FIG. 2. The grate 1 is also formed with two or more throughput apertures 27, all of which extend through the body of grate 1 from the top surface 28. The throughput apertures are typically elongated, extending generally from the second lateral surface 23 to the first lateral surface 24. Generally, throughput apertures that are located near the axis end 21 are shorter than throughput apertures located near the circumferential end 22. Each throughput aperture has a width, measured from the side of the throughput aperture nearest the axial end to the side of the throughput aperture nearest the circumferential end. The width of the elongated throughput aperture 27 can vary considerably, depending on the type of application. For example, with some applications, it may be desirable to reduce ore fragments to 0.25"(0.635 cm) diameters. In other applications, it may be desirable to reduce the ore fragments only to 4"(10.16 cm) diameters. Many applications require grates with throughput apertures that are between 1" to 3"(2.54–7.62 cm). With this system, grates 1 with throughput apertures 27 of a certain width can easily be replaced with grates 1 with throughput apertures 27 of a different width.

Figure 3:
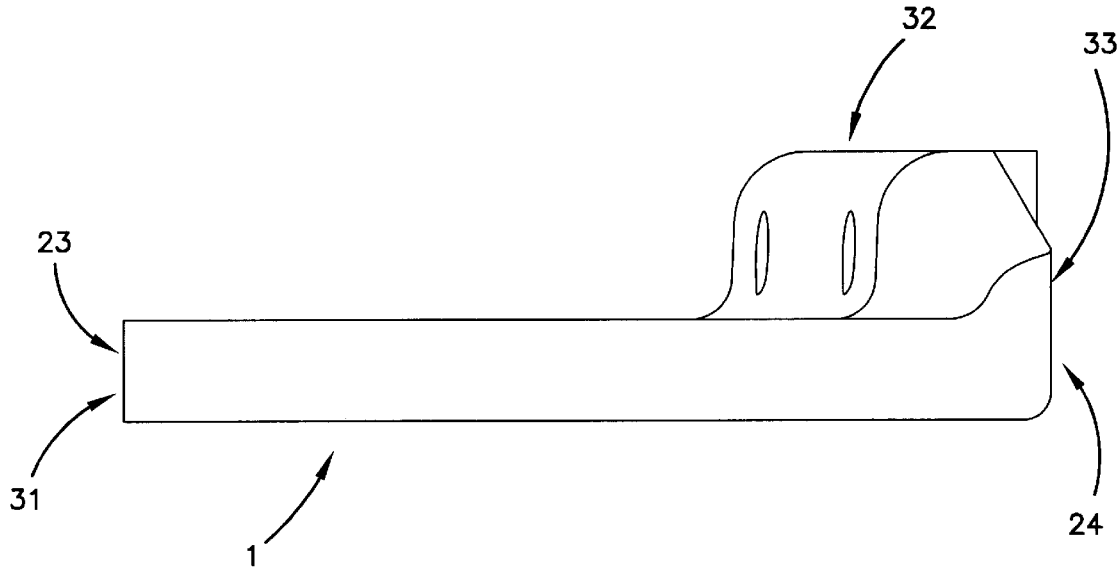
FIG. 3 is front view of the grate segment.

With reference to FIG. 3, a front view of grate 1 is shown, with second lateral surface 23 and first lateral surface 24. Grate 1 has a thickness 31, which can be uniform or varying. In most applications, the thickness 31 must be at least 2" (5.08 cm), while a thickness of at least 341 (7.62 cm) is preferred for most applications. A raised mounting portion 32 is located near the first lateral surface 24. The raised mounting portion 32 has a mounting thickness 33 greater than thickness 31 and can extend from the axis end 21 to the circumferential end 22, although it is possible to interrupt the mounting portion at a location between the axis end 21 and the circumferential end 22. Alternatively, the raised mounting portion 32 may be set back from either or both the axis end 21 and the circumferential end 22. The mounting thickness can be uniform, or varying, however it is generally preferred that the mounting thickness 33 is at least two times greater than the thickness 31.

Figure 4:
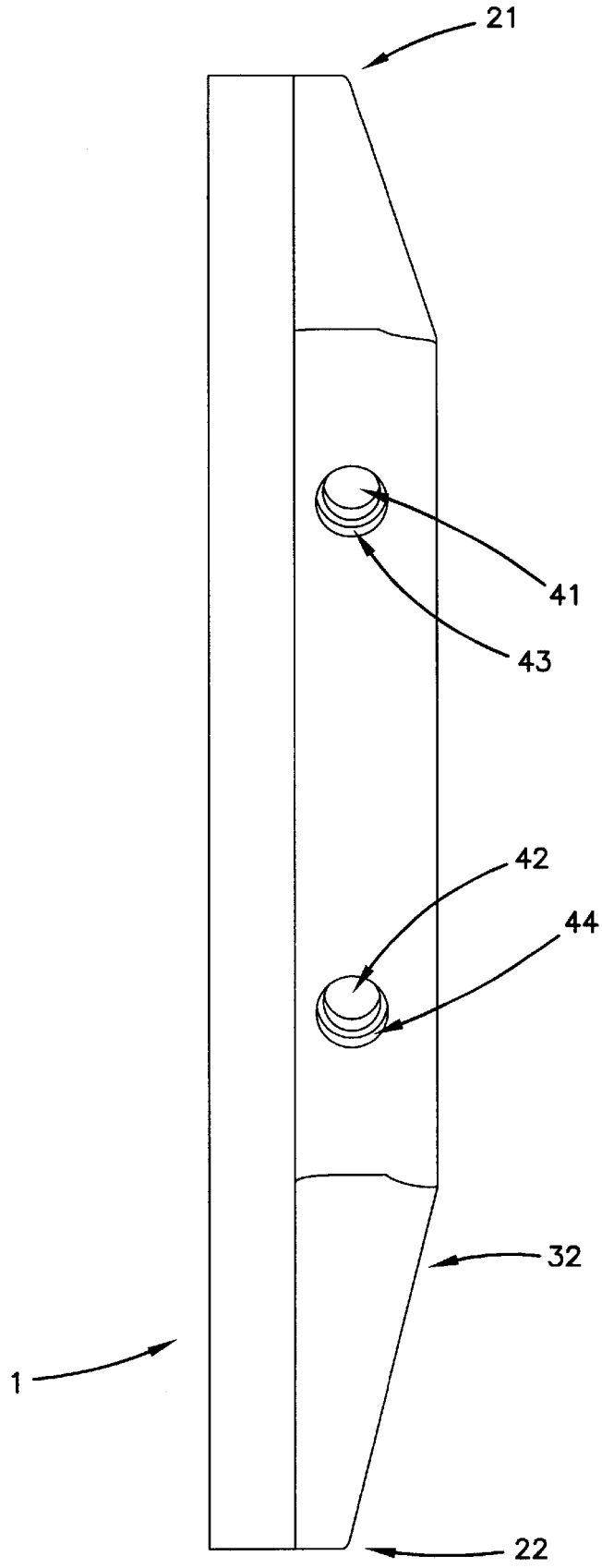
FIG. 4 is a side view of the grate segment.

With reference to FIG. 4, a side view of grate 1 is shown, with the axis end 21 and the circumferential end 22. Mounting bores 41 and 42 are shown. The mounting bores pass through the raised mounting portion 32 and must be of suitable size for a threaded member 4 of considerable strength to pass through. For example, mounting bores can range in diameter from 0.5"(1.27 cm) to over 3"(7.62 cm), depending on the application. In an alternative embodiment a recessed portion 43, 44 is disposed integrally with the mounting bore 41 so that a protective plug member 9 can be inserted into the recessed portion 43. In a preferred embodiment, the material around the mounting bores 41 and 42 may project outward as shown on the first lateral surface 24 in FIG. 2. This configuration, illustrated in FIG. 2 as support area 29 and support area 30, adds additional structural support.

Figure 5:
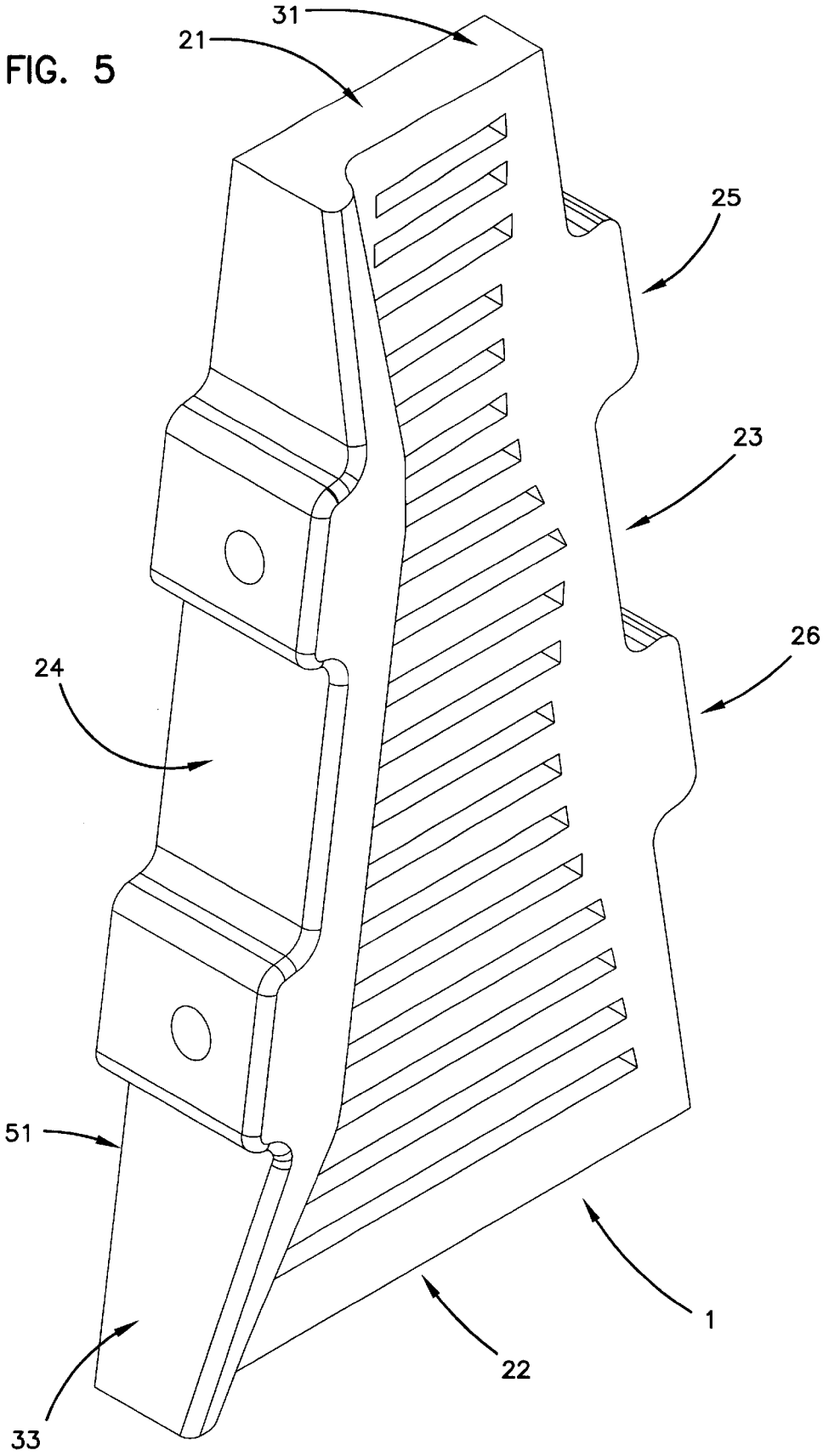
FIG. 5 is a schematic bottom perspective view of the grate segment.

Turning now to FIG. 5, the bottom surface 51 of grate 1 is shown with the first lateral surface 24 and the second lateral surface 23. The axis end 21 and the circumferential end 22 are also shown along with tabs 25 and 26, which extend outward from the second lateral surface 23. As described above, the mounting thickness 33 is shown to be greater than the thickness 31.

Figure 6:
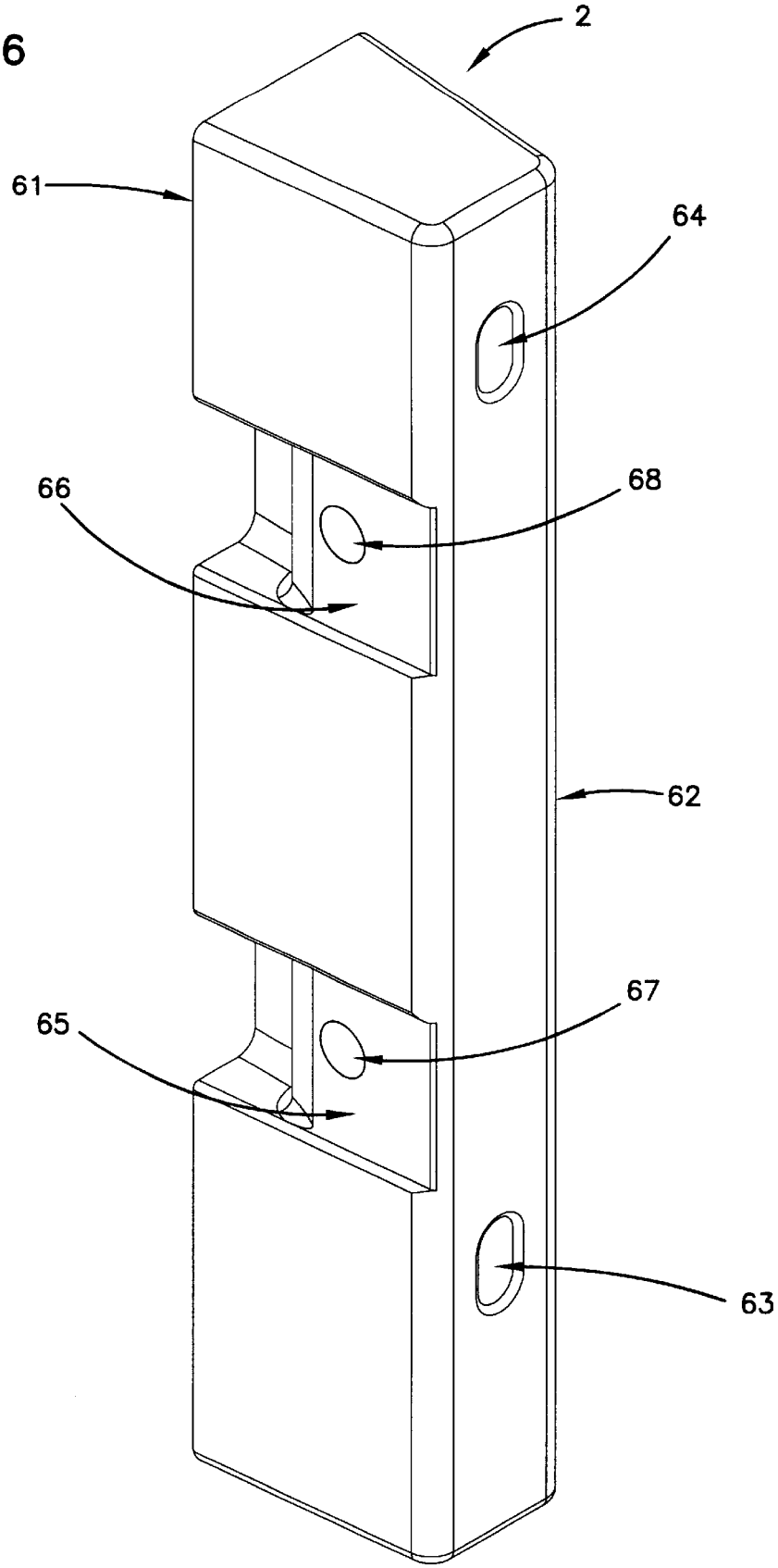
FIG. 6 is a schematic perspective view of the grate holder.

In FIG. 6, the grate holder 2 is shown with the pulp lifter contact surface 61 and the mounting surface 62. The grate holder 2 is typically cast from a ferrous alloy such as pearlitic steel or martensetic white iron. In any case a suitable material must be chosen to maximize the wear-resistant characteristic of the grate holder 2 while avoiding breakage due to brittleness. Anchor bores 63 and 64 are shown extending through the pulp lifter contact surface 61. The anchor bores 63 and 64 must be of suitable size and configuration to allow a fastening member, such as a bolt, to pass through the anchor bores 63 and 64 and affix the grate holder 2 to an existing pulp lifter located on the internal surface of a mill's rotating drum. Mounting bores 67 and 68 are shown extending through the mounting surface 62. Mounting bores 67 and 68 are alignable with mounting bores 41 and 42 on the grate 1 to facilitate the grate 1 installation process. Preferably, the mounting bores 41 and 42 on the grate are larger in diameter than the mounting bores 67 and 68 on the grate holder 2 for easier location.

Grate holder 2 may also be formed with recessed portions 65 and 66 located on the opposite side of the mounting surface 62. The recessed portions 65 and 66 are generally configured so tab 26 and tab 25 may fit within recessed portions 65 and 66. In an alternative embodiment, recessed portions 65 and 66 are configured to lock tab portions 25 and 26 in place. Additionally, the area around mounting bore 67 and mounting bore 68 on the mounting surface side 62, may also be recessed to align with support area 29 and support area 30 shown on the grate 1 in FIG. 2. This configuration can add structural support and minimize the wear and structural degradation of the tab 25, tab 26, support area 29 and support area 30.

Figure 7:
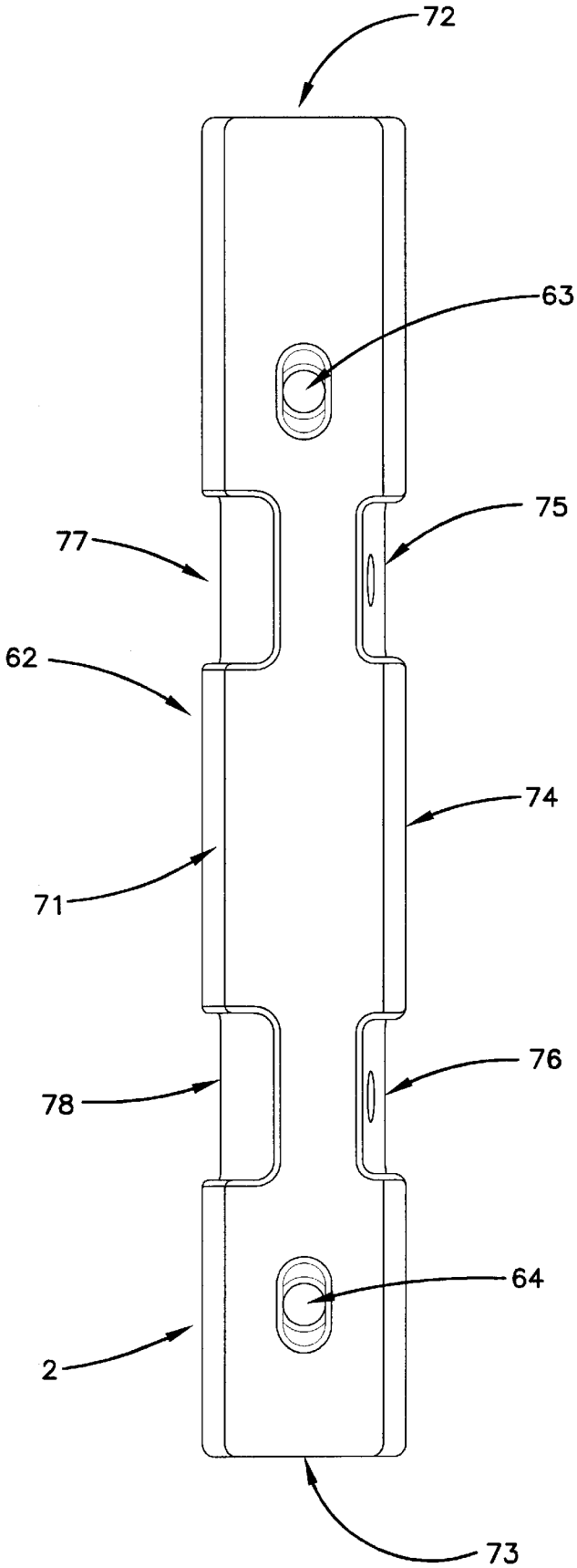
FIG. 7 is a top view of the grate holder.

With reference to FIG. 7, grate holder 2 is shown with top surface 71, located on the opposite side of the pulp lifter contact surface 61. Anchor bore 63 and anchor bore 64 are shown extending through the grate holder 2. Slot surface 74 is shown on the opposite side of the mounting surface 62. In an alternative embodiment, alignment portions 75 and 76 are shown as recessed areas on slot surface 74. The alignment portions 75 and 76 are not necessarily recessed as much as the recessed portions 65 and 66. Rather, tabs 25 and 26 should preferably be able to fit within recessed portions 66 and 65 and be securely disposed between alignment portions 75 and 76 and the surface of the pulp lifter on the interior of the mill. Guide portions 77 and guide portions 78 are shown on mounting surface 62. The guide portions 77 and 78 are generally configured to align with support area 29 and support area 30 on the grate 1. This configuration eases installation and may reduce structural degradation of the mounting bores 67 and 68.

Figure 8:
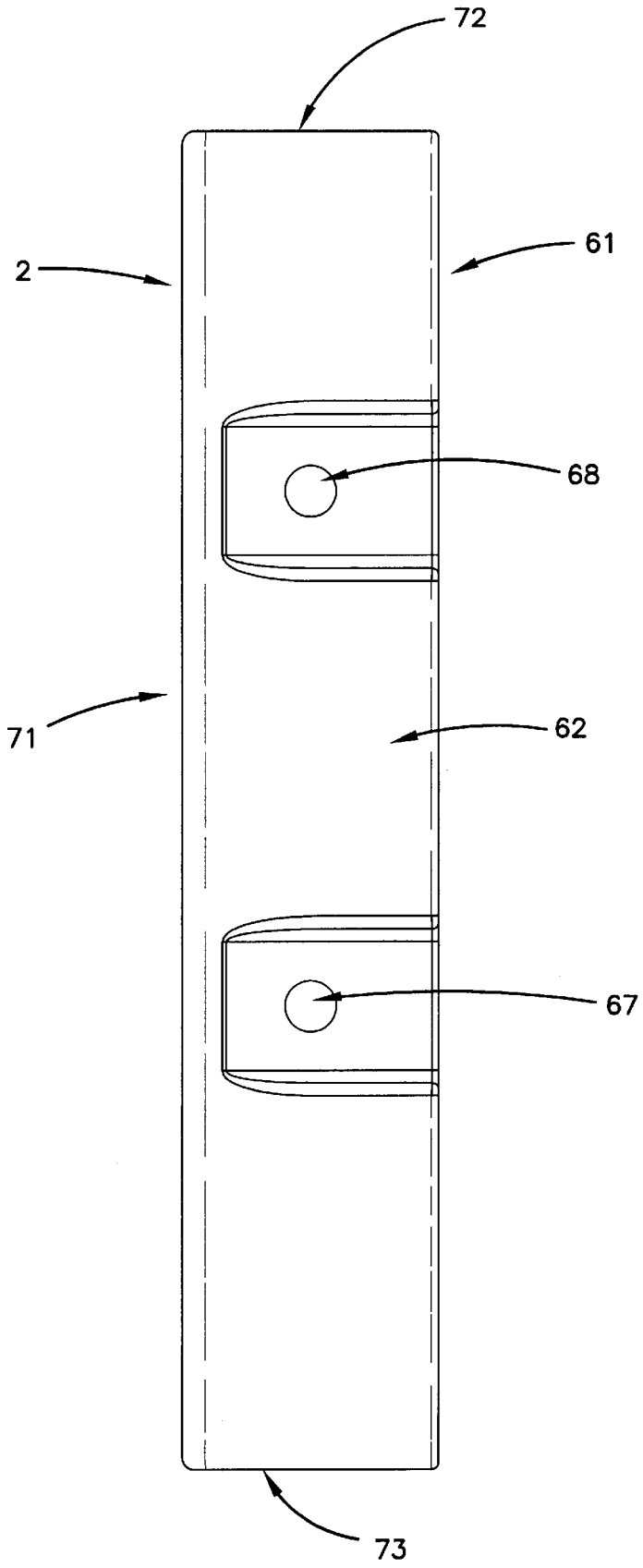
FIG. 8 is a side view of the grate holder.

With reference to FIG. 8, grate holder 2 is shown, with axial side 72, circumferential side 73, top surface 71, and pulp lifter contact surface 61. Mounting surface 62 is also shown with mounting bores 67 and 68. Mounting bores 67 and 68, as shown, extend through grate holder 2. In an alternative embodiment, mounting bores 67 and 68 may extend only partially through grate holder 2.

Figure 9:
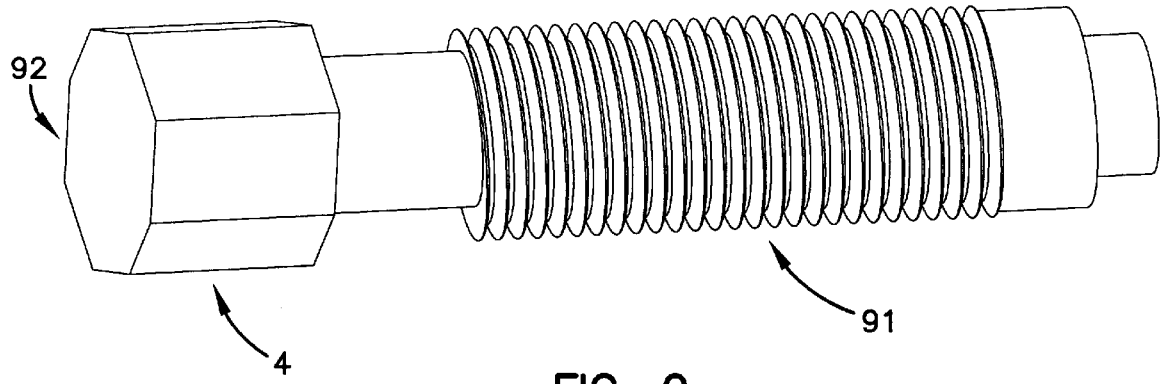
FIG. 9 is a perspective view of the threaded member.

With reference to FIG. 9, a threaded member 4 is shown. The threaded member 4 is alignable with the mounting bore 41 or mounting bore 42 of the grate 1 and mounting bore 67 or mounting bore 68 of the grate holder. While mounting bores 67, 68, 41, and 42 are generally circular in transverse configuration, the threaded member 4 also has a generally circular configuration. In the installation of the grate segment fastening system shown in FIG. 1, the grate 1 is fastened to the grate holder 3 by threaded members 4 and 5. The threaded member 4 is generally elongated with a threaded section 91 and a head section 92.

Figure 10:
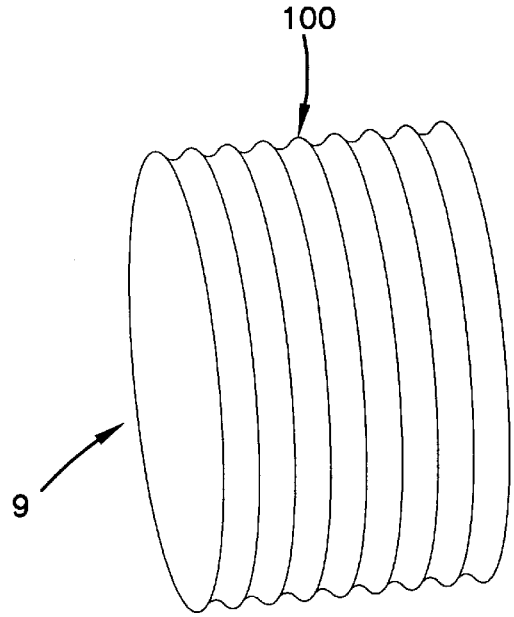
FIG. 10 is a perspective view of the protective plug member.

To protect the head section 92 and the threaded section 91 of the threaded member 4 from the internal environment of the mill, protective plug member 9 may be used. Protective plug member 9 is shown in FIG. 10 and may be inserted into recessed portion 43 or 44 of grate 1 to protect threaded member 4, and specifically the head section 92 of threaded member 4. The cross sectional configuration of protective plug member 9 corresponds to the recessed portions 43 and 44 as shown on FIG. 4. However, it is dimensioned to be slightly greater than recessed portions 43 and 44 to allow for a secure force fit.

In the preferred embodiment, protective plug member 9 is injection molded from urethane or other suitable polymer. It defines a plurality of coaxial barbed segments 100, each of which is angled to facilitate insertion into the recessed portion 43. As configured, and being slightly oversized relative to the recessed portion 43, protective plug member 9 initially can be placed into the recessed portion 43 and then pounded into place until its top surface is even with the surface of the grate 1.

As grinding takes place, grate 1 and grate holders 2 and 3 are continuously worn away, as is protective plug member 9. However, protective plug member 9 remains firmly in place to protect the threaded head section 92 of the threaded member 4. When the grate 1 has worn to the point that protective plug member 9 no longer exists, it is generally time for replacement of the grate 1.

Protective plug member 9 can be formed from different materials and take different structural forms. Generally, the protective plug member 9 will take the same transverse configuration as recessed portion 43 or 44, and will fill the cross section of recessed portion 43 to protect the threaded member 4. The protective plug member 9 desirably will include features for improving its retention in the recessed portion 43 during the ore grinding process.

When replacement of a grate 1 is necessary, the protective plug members 8 and 9 must be removed, if they are still in place, and then the threaded members 4 and 5 must be removed. At this point, a wrench may be applied to the head section 92 of the threaded members 4 and 5. The grate is then released from the grate holder 3 and the tabs 25 and 26 can be removed from the recessed portions 65 and 66 of the grate holder 2. Grate holders 2 and 3 can be inspected, e.g. visually, to determine whether they have experienced enough structural degradation from the internal milling operations to merit replacement. For example, if extensive wear appears to the top surface 71, the slot surface 74 or the mounting surface 62, the grate holders 2 and 3 should be replaced. If too much wear occurs, the grate holders 2 and 3 may not be able to effectively hold the grate 1 in place.

The above specification provides a complete description of the manufacture and use of the composition of the invention. Since many embodiments of the invention can be made without departing from the spirit and scope of the invention, the invention is not limited by the above description but is defined in the claims hereinafter appended.

We claim:

1. A grate segment fastening system for an ore comminuting machine, comprising:

a grate, including a top surface and a bottom surface opposite the top surface, wherein the top surface and the bottom surface are separated by a grate thickness, the grate being defined in use by an axis end, and a circumferential end opposite the axis end; wherein the grate is further defined by a first lateral surface, and a second lateral surface opposite the first lateral surface, the first lateral surface further comprising a raised mounting portion wherein at least one mounting bore extends through the body of the raised mounting portion, a plurality of throughput apertures extending through said grate from the top surface to the bottom surface and, a grate holder, including a top surface and a pulp lifter contact surface, opposite the top surface, the grate holder being defined by an axial end, and a circumferential end opposite the axial end, an anchor bore extending from the top surface of the grate holder to the pulp lifter contact surface, aligned mounting bore extending at least partially into a side mounting surface of the grate holder, and;

a threaded member insertable into the at least one mounting bore of the first lateral surface of the grate and the aligned mounting bore on the grate holder.

2. The grate segment fastening system of claim 1, wherein the grate holder is further defined by a slot surface having at least one recessed portion, and a mounting surface opposite the slot surface and wherein the grate further comprises at least one tab corresponding to a recessed portion on the grate holder.

3. The grate segment fastening system of claim 2, wherein the grate holder comprises a plurality of anchor bores.

4. The grate segment fastening system of claim 3, wherein the grate holder comprises a plurality of mounting bores corresponding to a plurality of aligned mounting bores in the raised mounting portion of the grate.

5. The grate segment fastening system of claim 4, further comprising a plurality of threaded members, of suitable size and configuration to fit into the plurality of aligned mounting bores in the raised mounting portion of the grate.

6. The grate segment fastening system of claim 5, wherein the raised mounting portion comprises a plurality of recessed portions integral with the plurality of mounting bores.

7. The grate segment fastening system of claim 1, further comprising a protective plug member sized and configured to fit into the mounting bore on the grate, thereby covering said threaded member from the internal environment of the ore comminuting machine.

8. The grate segment fastening system of claim 7, wherein the protective plug member is sized for frictional insertion into and retention within said mounting bore on the grate.

9. The grate segment fastening system of claim 1, wherein said plurality of throughput apertures are defined by elongated slots, wherein the ends of said elongated slots are at least 8" from the second lateral surface and at least 8" from the first lateral surface.

10. The grate segment fastening system of claim 9, wherein said plurality of throughput apertures measure between 0.25" and 4" (0.6–10.2 cm) wide.

11. The grate segment fastening system of claim 10, wherein said plurality of throughput apertures measure between 1" and 3" (2.5–7.6 cm) wide.

12. The grate segment fastening system of claim 11, wherein the grate thickness is non-constant.

13. The grate segment fastening system of claim 12, wherein the grate thickness is at least 2" (5.1 cm) thick.

14. The grate segment fastening system of claim 1, wherein the grate is cast from an iron ferrous alloy.

15. A method of fastening grate segments to the cylindrical interior surface of an ore grinding machine that eases grate segment installation and removal while maximizing the throughput of ore material, comprising:

fastening a first grate holder to a first pulp lifter on the cylindrical interior surface of the ore grinding machine, the first grate holder comprising a pulp lifter contact surface and a top surface on the opposite side of the pulp lifter contact surface, at least one anchor bore extends through the grate holder, from the top surface to the pulp lifter contact surface, whereby at least one fastener is inserted in the at least one anchor bore to the pulp lifter, to secure the first grate holder in place, the first grate holder further comprising at least one mounting bore located on a side mounting surface, placing a second grate holder to a second pulp lifter on the cylindrical interior surface of the ore grinding machine, the second grate holder comprising a pulp lifter contact surface and a top surface on the opposite side of the pulp lifter contact surface, at least one anchor bore extends through the second grate holder, from the top surface to the pulp lifter contact surface, whereby at least one fastener is inserted in the at least one anchor bore to the pulp lifter, to secure the second grate holder in place, the second grate holder further comprising at least one recessed portion located on a slot surface, securing a grate segment in place between the first grate holder and the second grate holder, the grate segment comprising a tab surface with at least one tab extending outward from the tab surface, whereby the at least one tab is configured to securely fit between the recessed portion of the second grate holder and the second pulp lifter, the grate segment further comprising a raised mounting portion whereby at least one mounting bore extends through the raised mounting portion and is configured to be aligned with the at least one mounting bore on the first grate holder, and inserting at least one threaded member through the at least one mounting bore on the grate into the at least one mounting bore on the first grate holder.

16. The method of fastening grate segments of claim 15, wherein the first grate holder further comprises at least one recessed portion integral with the at least one mounting bore on the first grate holder, the method further comprising:

inserting at least one protective plug member into the at least one recessed portion on the first grate holder.

17. A grate segment fastening system for an ore grinding machine that eases grate segment installation and removal while maximizing the throughput of ore material, comprising:

a grate, including a top surface and a bottom surface opposite the top surface, wherein the top surface and the bottom surface are separated by a grate thickness, the grate being defined by an axis side, and a circumferential side, opposite the axis side; wherein the grate is further defined by a second lateral surface, and a first lateral surface opposite the second lateral surface, the first lateral surface further comprising a raised mounting portion wherein at least one mounting bore of predetermined transverse size extends through the body of the raised mounting portion, the raised mounting portion having a mounting thickness greater than the grate thickness, a plurality of throughput apertures extending through said grate from the top surface to the bottom surface, said throughput apertures being elongated and extending generally from the second lateral surface to the first lateral surface and, at least one tab which protrudes outward from the second lateral surface and;

a first grate holder, including a top surface and a pulp lifter contact surface, opposite the top surface, the grate holder being defined by an axial side, and a circumferential side opposite the axial side, wherein the first grate holder is further defined by a slot surface having at least one recessed portion extending from the pulp lifter contact surface to a location between the pulp lifter contact surface and the top surface, the first grate holder also comprising a mounting surface opposite the slot surface, at least one anchor bore of predetermined transverse size extending through the first grate holder, from the top surface to the pulp lifter contact surface, an aligned mounting bore of predetermined transverse size disposed on the mounting surface of the first grate holder and;

a second grate holder, including a top surface and a pulp lifter contact surface, opposite the top surface, the second grate holder being defined by an axial side, and a circumferential side opposite the axial side, wherein the second grate holder is further defined by a slot surface having at least one recessed portion extending from the pulp lifter contact surface to a location between the pulp lifter contact surface and the top surface, the second grate holder also comprising a mounting surface opposite the slot surface, at least one anchor bore of predetermined transverse size extending through the second grate holder, from the top surface to the pulp lifter contact surface, the second grate holder further comprising an aligned mounting bore of predetermined transverse size disposed on the mounting surface and;

at least one threaded member insertable through the at least one mounting bore of the first lateral surface of the grate into the aligned mounting bore on the first grate holder.

18. A grate segment fastening system of claim 17, further comprising fastening bolts, configured to extend into the at least one anchor bore of the first grate holder or the second grate holder.

19. A grate segment fastening system of claim 17, wherein the first grate holder further comprises at least one alignment portion on the slot surface and at least one guide portion on the mounting surface.

20. A grate segment fastening system of claim 17, wherein the grate further comprises a recessed portion integral with the mounting bore on the grate, the grate segment fastening system further comprising a protective plug member, configured to be inserted into the recessed portion with a frictional fit.

21. A grinding mill for reducing the size of large ore fragments for further refining, the grinding mill comprising:

a hollow cylindrical rotatable drum arranged for rotation about a substantially horizontal axis in suitable bearings, the drum having an inlet end and an outlet end, a grate, including a top surface and a bottom surface opposite the top surface, wherein the top surface and the bottom surface are separated by a grate thickness, the grate being defined in use by an axis end, and a circumferential end opposite the axis end; wherein the grate is further defined by a first lateral surface, and a second lateral surface opposite the first lateral surface, the first lateral surface further comprising a raised mounting portion wherein at least one mounting bore extends through the body of the raised mounting portion, a plurality of throughput apertures extending through said grate from the top surface to the bottom surface and, a grate holder, including a top surface and a pulp lifter contact surface, opposite the top surface, the grate holder being defined by an axial end, and a circumferential end opposite the axial end, an anchor bore extending from the top surface of the grate holder to the pulp lifter contact surface, an aligned mounting bore extending at least partially into a side mounting surface of the grate holder and;

the at least one threaded member insertable into a mounting bore of the first lateral surface of the grate and the aligned mounting bore on the grate holder.

22. The mill of claim 21, further comprising:

a drive of conventional construction disposed at least partially within a housing, the drive being capable of rotating the drum.

23. The mill of claim 22, further comprising:

a conveyor in communication with the inlet, wherein the mill receives ore fragments through the inlet via the conveyor.

* * * * *